US006615457B2

(12) United States Patent
Kalinowski

(10) Patent No.: US 6,615,457 B2
(45) Date of Patent: Sep. 9, 2003

(54) BUTTON REPLACEMENT DEVICE

(76) Inventor: Anthony Kalinowski, 36 Hearthstone Dr., Medfield, MA (US) 02052

( * ) Notice: Subject to any disclaimer, the term of this patent is extended or adjusted under 35 U.S.C. 154(b) by 0 days.

(21) Appl. No.: 10/054,338

(22) Filed: Jan. 22, 2002

(65) Prior Publication Data

US 2003/0135961 A1 Jul. 24, 2003

Related U.S. Application Data

(63) Continuation-in-part of application No. 09/627,120, filed on Jul. 27, 2000, now Pat. No. 6,393,669.

(51) Int. Cl.[7] ..... A44B 1/18

(52) U.S. Cl. ..... 24/90.1; 24/108; 24/114.4; 24/342.1; 24/104; 24/62; 24/101 B

(58) Field of Search ..... 24/342.1, 90.1, 24/102 SL, 104, 108, 114.4, 103, 62, 101 B

(56) References Cited

U.S. PATENT DOCUMENTS

| | | | | | |
|---|---|---|---|---|---|
| 215,062 | A | | 5/1879 | Lambert | |
| 234,337 | A | | 11/1880 | Scott | |
| 658,965 | A | | 10/1900 | Senna | |
| 920,380 | A | * | 5/1909 | Noelle | 24/108 |
| 1,410,728 | A | | 3/1922 | Arcate et al. | |
| 1,419,696 | A | | 6/1922 | Smith | |
| 1,981,813 | A | * | 11/1934 | Schuster | 24/108 |
| 2,061,385 | A | | 11/1936 | Nadler | |
| 2,793,415 | A | | 5/1957 | Respini | |
| 2,901,796 | A | * | 9/1959 | Hope | 24/108 |
| 3,440,692 | A | * | 4/1969 | Pomerantz | 24/108 |
| 3,793,681 | A | | 2/1974 | Casstevens, Jr. et al. | |
| 3,892,013 | A | * | 7/1975 | Gould | 24/114.4 |
| 3,958,307 | A | * | 5/1976 | Ishizaki | 24/108 |
| 5,940,942 | A | * | 8/1999 | Fong | 24/459 |
| 6,393,669 | B1 | * | 5/2002 | Kalinowski | 24/90.1 |

* cited by examiner

*Primary Examiner*—Robert J. Sandy
(74) *Attorney, Agent, or Firm*—Blodgett & Blodgett, P.C.

(57) ABSTRACT

An apparatus for temporarily holding a button on a garment to replace a button which has been detached or lost from the garment. The apparatus includes a spring-like U-shaped clip that has an upper planar portion and a lower planar portion. The upper and lower planar portions are connected at their rear ends so that the front ends of the planar portions are resiliently moveable between a normal closed position in which the front ends of the planar members abut to an open position in which the front ends are separated. The front ends of the upper and lower planar members are biased toward each other in the closed position. The upper surface of the upper planar member is provided with a retainer for being connected to a button. More specifically, the upper the retainer with a retaining element having a receptive socket receiving a second retaining element. The second retaining element retainer having a one way connector which is either permanently attached to a button or is provided with a second one way connector insertion into one of the apertures of a conventional button.

19 Claims, 3 Drawing Sheets

BUTTON REPLACEMENT DEVICE

CROSS-REFERENCE TO RELATED APPLICATIONS

This application is a continuation-in-part (and claims the benefit of priority under 35 USC §120) of application of U.S. application Ser. No. 09/627,120 filed Jul. 27, 2000, now U.S. Pat. No. 6,393,669 B1. The disclosure of the prior application is considered part of (and is incorporated by reference in) the disclosure of this application.

STATEMENT REGARDING FEDERALLY SPONSORED RESEARCH OR DEVELOPMENT

This invention has been created without the sponsorship or funding of any federally sponsored research or development program.

BACKGROUND OF THE INVENTION

The present invention relates generally to a device for replacing a button that has become detached from a garment such as a shirt or a blouse.

When a button becomes detached from a garment, it usually occurs in circumstances where it is inconvenient, awkward, or impossible to replace it. In most cases, the button is lost before the person who is wearing the garment becomes aware that it has become detached from the garment.

A kit for replacing buttons has been developed and marketed. The kit includes a hand held tool which attaches a replacement button to a garment by means of a plastic fastener. The use of this tool is essentially a substitution for sewing the button on the garment. It is not practical to keep the kit on one's person to meet all emergency situations.

These and other difficulties experienced with the loss of a button from a garment have been obviated in a novel manner by the present invention.

It is a principal object of the invention to provide an apparatus for temporarily replacing a button which has become detached or lost from a garment.

A further object of the invention is to provide an apparatus for replacing a button, which apparatus can be carried easily and conveniently by a person at all times.

Another object of the invention is to provide an apparatus for temporarily replacing a button which is easy and convenient to use in essentially all circumstances.

A still further object of the invention is the provision of an apparatus for temporary reattachment of the button which has become detached from a garment or for attachment of a standard substitute button in the event that the original button has been lost.

still another object of the invention is the provision of a modified button and associated holding apparatus for temporary replacement of a button which has become detached or last from a garment.

With these and other objects in view, the invention resides in the combination of parts set forth in the specification and covered by the claims appended hereto.

BRIEF SUMMARY OF THE INVENTION

The present invention consists of an apparatus for temporarily holding a button on a garment to replace a button which has been detached or lost from the garment. The apparatus includes a spring-like U-shaped clip that has an upper planar portion and a lower planar portion. The upper and lower planar portions are connected at their rear ends so that the front ends of the planar portions are resiliently moveable between a normal closed position in which the front ends of the planar members abut to an open position in which the front ends of the planar members are separated. The front ends of the upper and lower planar members are biased toward each other in the closed position. The upper surface of the upper planar member is provided with a retainer for being connected to a button. More specifically, the upper planar member has a first retaining element having a receptive socket receiving a second retaining element. The second retaining element retainer has a one way connector which is either permanently attached to a button or is provided with a second one way connector for insertion into one of the apertures of a conventional button.

BRIEF DESCRIPTION OF THE DRAWINGS

The character of the invention, however, may be best understood by reference to one of its structural forms, as illustrated by the accompanying drawings in which.

DETAILED DESCRIPTION OF THE INVENTION

Figure 1:
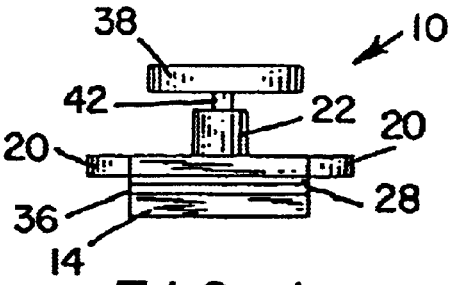
FIG. 1 is a front elevational view of a button holder embodying the principles of the present invention.
Figure 2:
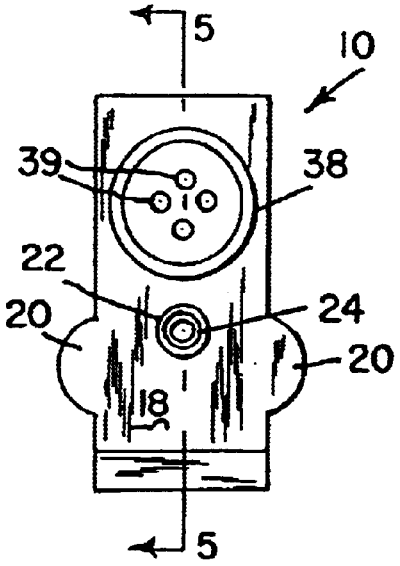
FIG. 2 is a top plan view of the button holder.
Figure 3:
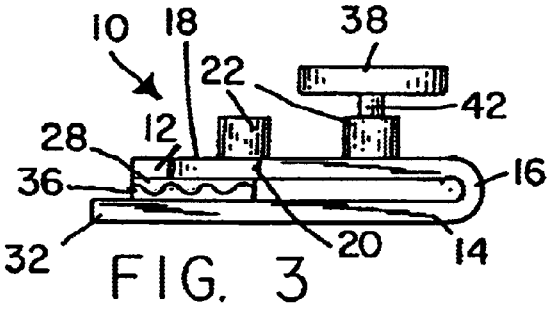
FIG. 3 is a side elevational view of the button holder, looking in the direction of arrow 3 of FIG. 2, showing the holder in its normal closed position.

Referring to FIGS. 1–5, the button holder of the present invention is generally indicated by the reference numeral 10 and includes a generally U-shaped spring clip having an upper planar member 12 and a lower planar member 14 which are connected at their rearward ends by a curved end portion 16.

The upper planar member 12 has an upper surface 18, a pair of laterally extending protuberances 20 and a pair of first retaining elements 22 extending upwardly from the upper surface 18. Each first retaining element 22 has a socket 24 and an annular ridge 26 within the socket 24 at a midpoint of the socket. A layer of elastomeric material 28 is fixed to the lower surface of the upper planar member 12 at the front end of the planar member. The layer 28 has a lower surface 30 which has alternating grooves and ridges. The grooves and ridges mate with similar grooves and ridges at the upper surface 31 of a layer of elastomeric material 36 fixed to the upper surface of the lower planar member 14 at the forward end of the planar member 14. The forward end of the lower planar member 14 has a forward portion 32 which extends forwardly beyond the forward end of the upper planar member 12.

Socket 24 is adapted to receive a second retaining element or one way connector, generally indicated by the reference numeral 40. Second retaining element 40 includes a shank portion 42 fixed at one end to a replacement button 38 and fixed at its other end to a pair of resiliently flexible barbs 46. An enlargement 44 is located between the button 38 and the barbs 46. The barbs 46 extend outwardly at an acute angle towards the enlargement 44. The second retaining element 40 is connected to one of the first retaining elements 22 by inserting the prong end of the second retaining element into the appropriate socket 24 so that the barbs 46 extend beyond the annular ridge 26. The prongs 46 bend inwardly toward each other when they are forced against the ridge 26 which allows the prongs to pass below the ridge 26. At this point, the barbs 46 return to their outwardly extending position and prevent the second retaining element from being withdrawn from the socket 24. The enlargement 44 is larger than the gap at the ridge 26 and prevents the second retaining element 22 from being pushed downwardly any further than is necessary and maintains the button 38 spaced above the first retaining elements 22.

Figure 4:
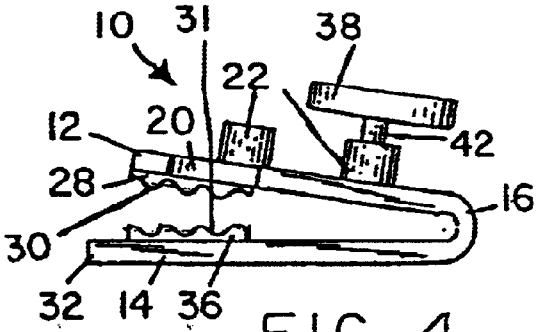
FIG. 4 is a view similar to FIG. 3 showing the holder in its open position.
Figure 5:
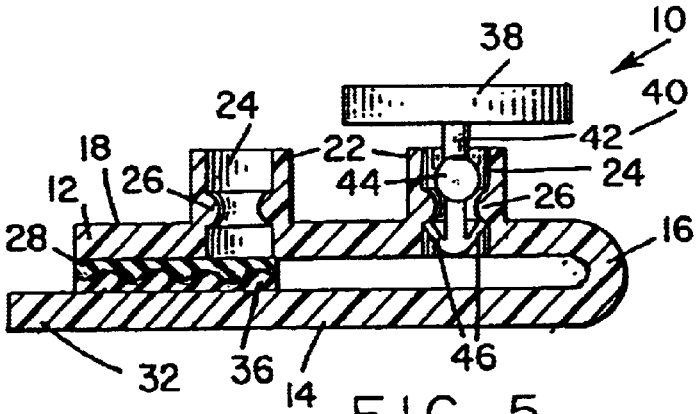
FIG. 5 is a cross-sectional view on an enlarged scale of the holder taken along line 5—5 of FIG. 2.

The button holder 10 of the present invention is utilized for replacing a lost or detached button from a garment by first selecting a button 38 from a kit which contains a plurality of buttons of different sizes and/or colors. All of the buttons in the kit have a second retaining element or one way connector 40 attached thereto. The appropriate button 38 is selected and a pronged end of the second retaining element 40 is inserted into the socket 24 of one of the first retaining elements 22. If the buttons on a garment are located near the edge of the garment, the rearmost retaining element 22 is used. If the buttons are located further from the edge of the garment, the forwardmost first retaining element 22 is utilized. After the button 38 has been fixed to one of the first retaining elements 22, the upper and lower planar members 12 and 14, respectively, are separated as shown in FIG. 4, by grasping the protuberances 20 between the index finger and the thumb. The forward end 32 of the lower panel 14 is positioned under the front panel of the garment containing the buttons at the point where the replacement button 38 is to be positioned. The upper planar member 12 is pulled upwardly by means of the protuberances 20 relative to the lower planar member 14 while applying downward pressure to the forward end 32 of the lower planar member with the user's other hand. With the button holder 10 open in the open position, as shown in FIG. 4, the forward end of the holder is moved inwardly from the edge of the garment panel until the button holder is fully inserted on the panel. At this point, the button 38 will be positioned at the same point on the garment panel as was occupied by the original button of the garment. The garment can be rebuttoned using the replacement button. All that will be seen from the outside is the replacement button 38, since the button holder will be located beneath the garment panel which contains the button holes. The button 38 can be a conventional button having the usual apertures 39. The shank portion 42 of the second retaining element 40 is fixed to the button. The button 38 can also be integrally formed with second retaining element 40.

Figure 6:
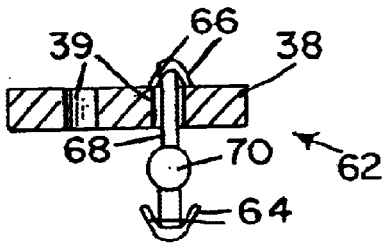
FIG. 6 is an elevation view of a modified button retainer for use with the button holder of the present invention.

Referring to FIG. 6, there is shown a modified second retaining element, generally indicated by the reference numeral 62, which is attachable to the button 38 and to one of the second retaining elements 22. Second retaining element 62 is a one way connector having a shank portion 68 and barbs 64 at one end of the shank portion and barbs 66 at the opposite end of the shank portion. Each of the barbs 64 and 66 are resiliently flexible and function in the same manner as the barbs 46 of the second retaining element 40. An enlargement 70 is located between the pair of barbs 64 and the pair of barbs 66. The one way connector 62 is attached to the button 38 by inserting the barbs 66 into one of the apertures 39 of the button, as shown in FIG. 6. The second retaining element 62 is then attached to one of the first retaining elements 22 in the same manner as the second retaining element 40. This modification enables the kit to contain a plurality of conventional buttons of different sizes and colors and also enables the original button of the garment to be used if that button had become detached from the garment but not lost.

Figure 7:
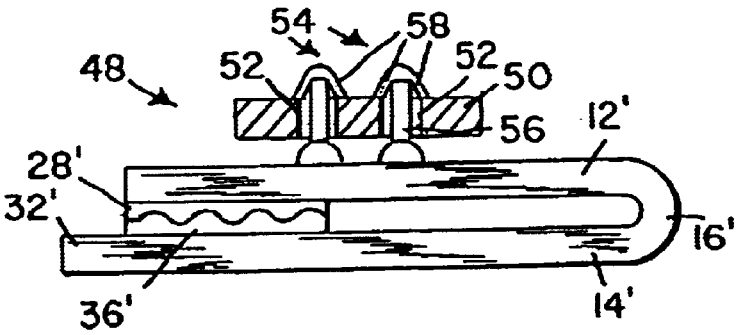
FIG. 7 is a side elevational view of a first modified button holder.
Figure 8:
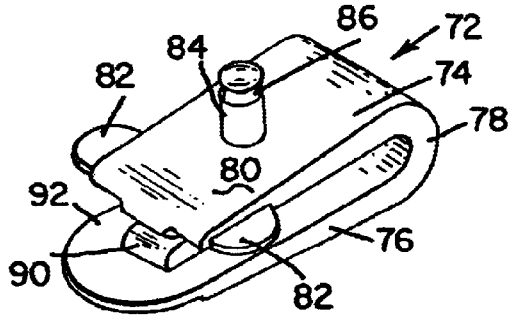
FIG. 8 is an isometric view of a second modified button holder for use with a removable button.
Figure 9:
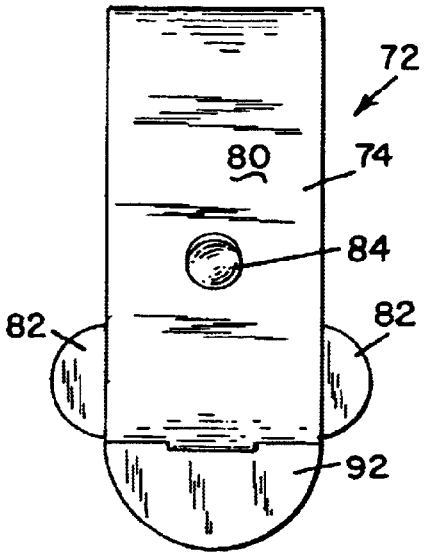
FIG. 9 is a top plan view of the second modified button holder.
Figure 11:
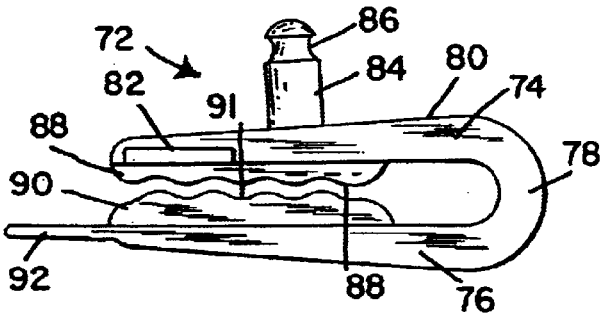
FIG. 11 is a second elevational view of the second modified button holder, looking in the direction of arrow 11 in FIG. 10.
Figure 10:
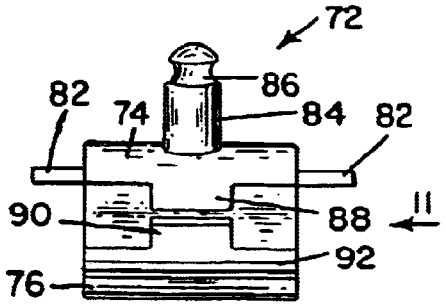
FIG. 10 is a front elevational view of the second modified button holder.

Referring to FIG. 7, there is shown a first modified button holder, generally indicated by the reference numeral 48, which is similar to the button holder 10. All portions of the button holder 48 which are identical to those of button holder 10 are identified with the same reference numerals, with the addition of a prime. The button holder 48 differs from the button holder 10 primarily in the fact that it does not have the first retaining elements 22. A pair of retaining elements or one way connectors, generally indicated by the reference numeral 54, are fixed to the upper surface of the upper planar member 12', as shown in FIG. 7. Each retaining element 54 has a shank portion 56 and a pair of resiliently flexible barbs 58 at the upper end of the shank portion 56. The barbs 58 extend downwardly and outwardly at an acute angle to the shank portion 56. The retaining elements 54 are connected to a convention button 50 having apertures 52. The barbs 58 of both connectors 54 are inserted into two of the apertures 52 of the button on one side of the button until they extend beyond the opposite side of the button. At this point, the barbs 58 which were forced inwardly as they were pushed past the apertures to return to their normal outwardly extending state and, thereby, engage the opposite or upper surface of the button as shown in FIG. 7 and prevents the button 50 from being withdrawn from the one way connectors 54. In this embodiment of the invention, any button in a kit of diverse buttons or the original button of the garment which had become detached from the garment can be utilized. Once the button 50 has been attached to the button holder 48, the button holder 48 can be applied to the garment in the same manner as that which was described for the button holder 10.

Referring to FIGS. 8–11, a second modified button holder is generally indicated by the reference numeral 72 and includes a generally U-shaped spring clip having an upper planar member 74 and a lower planar member 76 which are connected at their rearward ends by a curved end portion 78. The button holder 72 is made of a resiliently flexible thermoplastic material.

Figure 13:
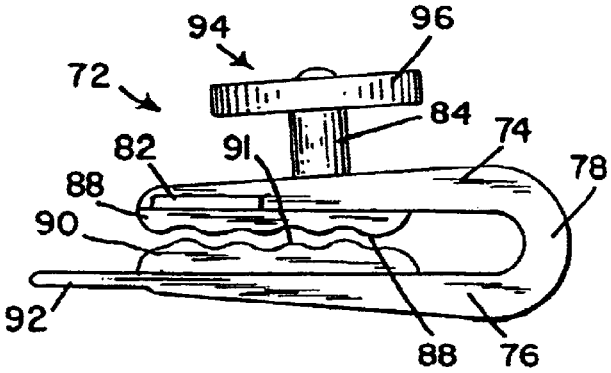
FIG. 13 is a view similar to FIG. 11 showing the removable button of FIG. 12 applied to the second modified button holder.

The upper planar member has an upper surface 80, a pair of laterally extending protuberances 82 and a first retainer in the form of a cylindrical post extending upwardly from the upper surface 80. The upper free end of the post 84 has an annular groove 86. A first gripping protuberance 88 extends downwardly from the lower surface of the upper planar member 74. A second gripping protuberance 90 extends upwardly from the upper surface of the lower planar member 76. The protuberance 88 has a lower surface 89 which has alternating grooves and ridges. The grooves and ridges of surface 89 mate with similar grooves and ridges at the upper surface 91 of the protuberances 90. The forward end of the lower planar member 76 has a forward portion 92 which extends forwardly beyond the forward end of the upper planar member 74. The planar members 74 and 76 are biased toward each other in a closed position and are shown slightly open in FIGS. 11 and 13. The extending portion 92 and the protuberances 82 are used to separate the members 74 and 76 in the same manner as described for embodiment 10.

Figure 14:
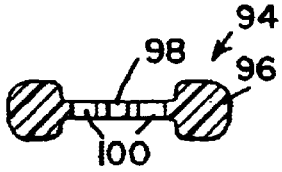
FIG. 14 is a vertical cross-sectional view taken along line 14—14 of FIG. 12 and looking in the direction of the arrows.
Figure 12:
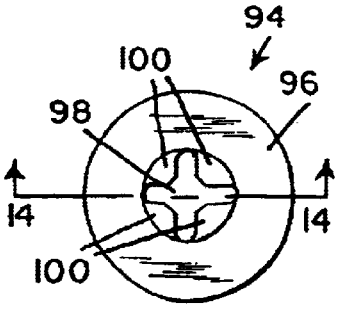
FIG. 12 is a top plan view of a removable button adapted for use with the second modified button holder.

Referring to FIGS. 12 and 14, there is illustrated a replaceable button, generally indicated by the reference numeral 94 which is adapted to be used with the holder 92. Button 94 has a conventional disc shaped main body portion 96 which contains a central aperture 98. A plurality of evenly spaced tabs 100 extend into the aperture 98. the button 94 is made of a resiliently flexible material such as plastic so that the tabs 100 are resiliently flexible. The main body portion 96 has a cross-sectional dimension of each which is at least twice that of the cross-sectional dimension of the tabs 100. Preferably, the cross-sectional dimension of each tab 100 is substantially ⅓ that of the cross-sectional dimension of the main body portion 96. This enables the tabs 100 to be more flexible relative to the main body portion.

The button 94 is removably attached to the post 84 by inserting the upper free end of the post 84 into the aperture 98 and forcing the button downwardly to the upper surface 80. This causes the tabs 100 to deflect upwardly and then snap into the groove 86 and enables the button to be held firmly in place. The button 94 is removed from the post 84 by pulling the button upwardly relative to the holder 72. This causes the tabs 100 to deflect downwardly and out of the groove 86.

One of the advantages of having a removable button for the holder 72 is that the holder can be part of a button replacement kit that includes a plurality of removable buttons of different sizes and colors to suit most situations in which a button has been lost from a garment.

Clearly, minor changes may be made in the form of the invention without departing from the materials, thereof. It is not, however, desired to confine the invention to the exact form herein shown and described, but is desired to include all such as properly come within the scope claimed.

The invention having been thus described, what is claimed new and desired to secure by Letters Patent is:

What is claimed is:

1. A button holder comprising:

(a) an upper planar member having an upper surface, a lower surface, a rearward end and a free forward end, said upper planar member having a first retainer at the upper surface of said upper planar member;

(b) a lower planar member vertically aligned with said upper member and having an upper surface, a lower surface, a free forward end and a rearward end connected to the rearward end of said upper planar member, the connection between the rearward ends of said upper and lower planar members resiliently bendable for biasing said free forward ends into an abutting closed position, said forward ends being separable against said biasing to an open position; and (c) a button having an aperture and a second retainer at said aperture, said second retainer being complementary to said first retainer for enabling said button to be removably connected to said first retainer.

2. A button holder as recited in claim 1, wherein said button holder is made of thermoplastic material.

3. A button holder as recited in claim 1, wherein said first retaining element, is a cylindrical post that extends upwardly from the upper surface of said upper planar member, said post having an upper free end and an annular groove adjacent said upper free end.

4. A button holder as recited in claim 3, wherein said second retainer is at least one resiliently flexible tab extending into said aperture.

5. A button holder as recited in claim 4, wherein said second retainer is at least two diametrically opposed resiliently flexible tabs extending into said aperture.

6. A button holder as recited in claim 4, wherein said second retainer is four evenly spaced resiliently flexible tabs extending into said aperture.

7. A button holder as recited in claim 4, wherein said button has a main body portion containing said aperture and said main body portion has a cross-sectional dimension which is at least twice the cross-sectional dimension of said tab.

8. A button holder as recited in claim 1, wherein said upper planar member has a first horizontally extending protuberance and said lower planar member has a second horizontally extending protuberance out of vertical alignment with said first horizontally extending protuberance.

9. A button holder as recited in claim 8, wherein said first horizontally extending protuberance extends laterally from said upper planar member and said second horizontally extending protuberance extends forwardly of the forward free end of said upper planar member.

10. A button holder as recited in claim 1, wherein said upper planar member has a pair of oppositely extending lateral protuberances and the forward free end of said lower planar member extends forwardly of the forward free end of said lower planar member.

11. A button holder as recited in claim 1, wherein each of said forward free ends has an abutting surface and wherein one of said abutting surfaces has at least one convex portion and the other of said abutting surfaces has at least one concave portion which is vertically aligned with said convex portion.

12. A button holder as recited in claim 1, wherein the lower surface at the forward free end of said upper planar member and the upper surface at the forward free end of said lower planar member each has a plurality of ridges and a plurality of grooves which alternate with said ridges, the ridges of each of said planar members being vertically aligned with the grooves of the other of said planar members.

13. A button holder comprising:

(a) an upper planar member having an upper surface, a lower surface, a rearward end and a free forward end;

(b) a lower planar member vertically aligned with said upper member and having an upper surface, a lower surface, a free forward end and a rearward end connected to the rearward end of said upper planar member, the connection between the rearward ends of said upper and lower planar members resiliently bendable for biasing said free forward ends toward each other in a closed position, so that the lower surface of said upper planar member and upper surface of said lower planer member at said forward free ends abut, said forward ends being separable against said biasing to an open position at which said abutting surfaces are spaced; and (c) a first retainer connected to the upper surface of said upper planer member for being removably connected to a button that has a complementary second retainer.

14. A button holder as recited in claim 13, wherein said first retaining element is a cylindrical post that extends upwardly from the upper surface of said upper planar member, said post having an upper free end and an annular groove adjacent said upper free end.

15. A button holder as recited in claim 13, wherein said upper planar member has a first horizontally extending protuberance and said lower planar member has a second horizontally extending protuberance out of vertical alignment with said first horizontally extending protuberance.

16. A button holder as recited in claim 15, wherein said first horizontally extending protuberance extends laterally from said upper planar member and said second horizontally extending protuberance extends forwardly of the forward free end of said upper planar member.

17. A button holder as recited in claim 13, wherein said upper planar member has a pair of oppositely extending lateral protuberances and the forward free end of said lower planar member extends forwardly of the forward free end of said lower planar member.

18. A button holder as recited in claim 13, wherein each of said forward free ends has an abutting surface and wherein one of said abutting surfaces has at least one convex portion and the other of said abutting surfaces has at least one concave portion which is vertically aligned with said convex portion.

19. A button holder as recited in claim 13, wherein the lower surface at the forward free end of said upper planar member and the upper surface at the forward free end of said lower planar member each has a plurality of ridges and a plurality of grooves which alternate with said ridges, the ridges of each of said planar members being vertically aligned with the grooves of the other of said planar members.

* * * * *